US011225956B2

(12) United States Patent
Argentino

(10) Patent No.: US 11,225,956 B2
(45) Date of Patent: Jan. 18, 2022

(54) VALVE UNIT FOR PUMPS

(71) Applicant: ANNOVI REVERBERI S.P.A., Modena (IT)

(72) Inventor: Pierluigi Argentino, Castelfranco Emilia (IT)

(73) Assignee: ANNOVI REVERBERI S.P.A., Modena (IT)

( * ) Notice: Subject to any disclaimer, the term of this patent is extended or adjusted under 35 U.S.C. 154(b) by 0 days.

(21) Appl. No.: 16/982,679

(22) PCT Filed: Feb. 5, 2019

(86) PCT No.: PCT/IB2019/050899
§ 371 (c)(1),
(2) Date: Sep. 21, 2020

(87) PCT Pub. No.: WO2019/186288
PCT Pub. Date: Oct. 3, 2019

(65) Prior Publication Data

US 2021/0025377 A1 Jan. 28, 2021

(30) Foreign Application Priority Data

Mar. 27, 2018 (IT) ..... 102018000003995

(51) Int. Cl.
*F04B 35/04* (2006.01)
*F04B 49/24* (2006.01)
(Continued)

(52) U.S. Cl.
CPC ..... *F04B 35/04* (2013.01); *F04B 49/035* (2013.01); *F04B 49/22* (2013.01); *F04B 49/24* (2013.01);
(Continued)

(58) Field of Classification Search
CPC ..... F04B 35/04; F04B 35/002; F04B 35/06; F04B 49/035; F04B 49/22; F04B 49/24;
(Continued)

(56) References Cited

U.S. PATENT DOCUMENTS 2,395,941 A * 3/1946 Rockwell ..... F15B 1/027 137/115.15
2,858,842 A * 11/1958 Reis ..... F04B 49/035 137/115.26
(Continued)

FOREIGN PATENT DOCUMENTS

EP 1413755 A2 4/2004

*Primary Examiner* — Essama Omgba
*Assistant Examiner* — Christopher J Brunjes
(74) *Attorney, Agent, or Firm* — Volpe Koenig

(57) ABSTRACT

A valve unit for pumps includes a first chamber communicating with an inlet conduit and with a discharge conduit, a second chamber communicating with the first via a first valve seat and with an outlet conduit. A first obturator body housed within the second chamber opens and closes the first valve seat. A third chamber communicates with the second chamber and partially defined by a sliding plunger. A second obturator body, rigidly connected to the plunger and housed within the first chamber, opens and closes the second valve seat. An internal cavity in the second obturator body communicates with the first chamber, a connection conduit in the second obturator body, communicates with the discharge conduit and with the internal cavity via a third valve seat. A third obturator body housed within the internal cavity of the second obturator body opens and closes the third valve seat.

9 Claims, 3 Drawing Sheets

(51) Int. Cl.

| | |
|---|---|
| ***F04B 53/10*** | (2006.01) |
| ***F04B 49/22*** | (2006.01) |
| ***F04B 49/035*** | (2006.01) |
| *F04B 17/05* | (2006.01) |
| *F04B 35/00* | (2006.01) |

(52) U.S. Cl.
CPC ..... *F04B 53/10* (2013.01); *F04B 17/05* (2013.01); *F04B 35/002* (2013.01)

(58) Field of Classification Search
CPC ..... F04B 53/10; F04B 17/05; F16K 17/04; F16K 17/048; F16K 11/105
USPC ..... 417/302–304; 137/565.35, 614.16–17, 137/115.16–18
See application file for complete search history.

(56) References Cited

U.S. PATENT DOCUMENTS 5,718,255 A * 2/1998 Gilpatrick ..... F04B 17/05 137/10
2009/0205716 A1* 8/2009 Benetti ..... G05D 16/10 137/99
2009/0317262 A1* 12/2009 Gilpatrick ..... B08B 3/026 417/34

* cited by examiner

VALVE UNIT FOR PUMPS

TECHNICAL FIELD

The present invention concerns a valve unit for positive displacement pumps, in particular for positive displacement pumps using pistons that can be installed on pressure washers or on other machines for distributing and/or dispensing pressurised fluids (typically water).

STATE OF THE ART

As known, positive displacement pumps using pistons generally comprise an intake manifold adapted for being connected to a tank of the fluid to be pumped, a delivery manifold adapted for being connected to a device for dispensing the fluid (for example to a dispensing spout or gun), and an adjustment valve, hydraulically arranged between the delivery manifold and the dispensing device, which is adapted for adjusting the maximum dispensing pressure of the fluid.

Conventionally, the adjustment valve comprises an inlet conduit communicating with the delivery manifold, an outlet conduit communicating with the dispensing device and a discharge or by-pass conduit communicating with the intake manifold.

The adjustment valve also comprises a first chamber communicating with the inlet conduit and with the discharge conduit, and a second chamber communicating with the first chamber and with the outlet conduit.

The second chamber houses a first obturator body that, pushed by a first resilient element (e.g. by a spring), is normally adapted for cooperating with a first valve seat to close the communication between the first chamber and the second chamber.

The first chamber receives a second obturator body that, pushed by a second resilient element (e.g. by a spring), is normally adapted for cooperating with a second valve seat to close the communication between the first chamber and the discharge conduit.

The second obturator body is carried by a stem that pokes out from the first chamber and extend inside a third chamber, which is in communication with the second chamber and is partially delimited by a plunger fixed firmly to the piston itself.

In this way, the pressure in the third chamber, which is substantially equal to the pressure that exists in the second chamber and in the outlet conduit, tends to push the plunger, and with it the stem and the second obturator body, in the direction to open the second valve seat, in contrast with the second resilient member.

Thanks to this solution, while the second obturator body remains in closed position, the fluid pumped by the pump pushes the first obturator body in contrast with the first resilient element, opening the communication between the first and the second chamber and thus being able to flow from the latter towards the outlet conduit.

If, on the other hand, the pressure in the outlet conduit increases beyond a predetermined limit value, for example because the dispensing device is closed or due to an increase in the amount of fluid pumped, the push exerted on the plunger by the pressure in the third chamber causes the movement of the second obturator body, opening the discharge conduit and thus allowing the recirculation of at least part of the fluid pumped directly and again towards the intake manifold.

Although it is effective in normal operation, the adjustment valve outlined above has a drawback that occurs when the pump is started, especially when the pump is actuated by an internal combustion engine.

In this type of application, the internal combustion engine is indeed generally of the pull-cord type, i.e. started through a cable that is pulled manually by the user to make the engine carry out the first rotations necessary to start it. Since the engine is constantly connected to the pump, these first rotations however cause the pumping of a small amount of fluid that causes the sudden increase in pressure in the delivery manifold of the pump and, through the adjustment valve, along the outlet conduit up to the dispensing device.

Therefore, if during the course of these first rotations the engine accidentally does not manage to start, the hydraulic resistance of the pump would become very high and the force that the operator should exert to try to set the engine in rotation again would be excessive, actually preventing the engine from being started without discharging the pressure every time through the opening of the dispensing device.

An analogous drawback is sometimes also encountered when the pump is actuated by electric motors, especially by electric motors with inverter, which start with a low number of revs and therefore with much lower torque values than the nominal ones, so that they might not manage to overcome the hydraulic resistance of the pump.

In order to overcome the aforementioned drawbacks, it is known to use a by-pass valve, separate and distinct from the adjustment valve, which comprises an internal cavity, communicating with the first chamber of the adjustment valve, and a connection conduit adapted for placing said internal cavity in communication with the discharge conduit, i.e. with the intake manifold, making a sort of recirculation.

The internal cavity receives a third obturator body adapted for cooperating with a corresponding valve seat to close the connection conduit and a third resilient element (e.g. a spring), which is adapted to push the obturator body away from the valve seat, so as to keep the by-pass valve normally open.

Thanks to this solution, when the pump is started, the first chamber of the adjustment valve is in communication with the intake manifold through the by-pass valve, so that the first pumping cycles produce only a recirculation of fluid from the delivery manifold to the intake manifold that generates only a minimal hydraulic resistance.

When, on the other hand, the motor has started and the flow rate of pumped fluid approaches the nominal values, the dynamic push exerted by the transiting fluid causes the movement of the third obturator body in contrast with the corresponding resilient element, causing the by-pass valve to close and forcing all of the pumped fluid to flow towards the outlet conduit of the adjustment valve as usual.

However, the valve unit globally defined by the adjustment valve and by the by-pass valve is very bulky and complicated from the constructive point of view, correspondingly increasing the production and assembly costs of the pump.

DESCRIPTION OF THE INVENTION

A purpose of the present invention is to overcome the aforementioned drawbacks of the prior art, with a simple, rational and low-cost solution.

Such purposes and others are accomplished by the characteristics of the invention given in independent claim 1. The dependent claims outlined preferred and/or particularly advantageous aspects of the invention.

In particular, an embodiment of the present invention provides a valve unit for pumps, for example for positive displacement pumps typically using pistons, comprising:

an inlet conduit, a first chamber communicating with the inlet conduit, a second chamber communicating with the first chamber via a first valve seat, a outlet conduit communicating with the second chamber, a first obturator body housed within the second chamber and movable between a closed position, in which it closes the first valve seat, and an open position, in which it opens the first valve seat, a first resilient element adapted to push the first obturator body towards the closed position in contrast with the pressure present in the first chamber, a discharge conduit communicating with the first chamber via a second valve seat, a third chamber communicating with the second chamber and partially defined by a sliding plunger, a second obturator body rigidly connected to the plunger and housed within the first chamber where it is movable between a closed position, in which it closes the second valve seat, and an open position, in which it opens the second valve seat, and a second resilient element adapted to push the second obturator body towards the closed position in contrast with the pressure present in the third chamber, an internal cavity obtained in the second obturator body and communicating with the first chamber, a connection conduit obtained in the second obturator body, which is in communication with the discharge conduit and is in communication with the internal cavity via a third valve seat, a third obturator body housed within the internal cavity of the second obturator body and movable between a closed position, in which it closes the third valve seat, and an open position, in which it opens the third valve seat, and a third resilient element adapted to push the third obturator body towards the open position in contrast with the pressure present in the first chamber.

Thanks to this solution, the adjustment valve and the by-pass valve are practically integrated with one another, reducing the overall weight and bulk, as well as reducing the number of components and therefore the manufacturing and assembly costs of the valve unit.

According to one aspect of the invention, the third obturator body can be a spherical body.

In this way, the third obturator body can effectively close the third valve seat, while still remaining a solution that is very simple and cost-effective to make.

Another aspect of the invention provides that the internal cavity of the second obturator body can be a cylindrical cavity, for example a cylindrical cavity having axis parallel to the direction along which the second obturator body moves from its closed position to its open position and vice-versa.

Thanks to this solution, the internal cavity of the second obturator body is simple and cost-effective to make and makes it possible to effectively guide the third valve body housed in it.

According to a further aspect of the invention, the ratio between the diameter of the internal cavity of the second obturator body and the diameter of the third obturator body is preferably less than or equal to 1.25.

For dimensional ratios higher than the one indicated a poor efficiency of the by-pass valve has indeed been found, probably due to the fact that the passage section for the fluid increases to the point of not introducing a significant load loss, with the result that the third obturator body remains in open position even when the pump has reached the nominal operating condition, causing a continuous recirculation of fluid that reduces the efficiency of the pump and the useful flow rate of fluid pumped towards the users.

Another aspect of the present invention provides that the third valve seat can be a circular seat, for example a circular seat coaxial to the internal cavity of the second obturator body.

In this way, the valve seat is simple to make and generates an effective sealed coupling with the third obturator body.

According to an aspect of the invention, the ratio between the diameter of the third obturator body and the diameter of the third valve seat can be less than or equal to 1.25.

The effect of this solution is to ensure that the obturator body remains in closed position during the normal operation of the pump, reducing the possibility of the latter being able to open accidentally due to transients.

Indeed, the greater the diameter of the third valve seat the greater the force that the pressure of the fluid in the first chamber of the valve unit exerts on the third obturator body, pushing it towards the closed position of the discharge conduit.

The present invention also provides a pump, for example a positive displacement pump typically using pistons, comprising an intake manifold, a delivery manifold and the valve unit outlined above having the inlet conduit in communication with the delivery manifold.

This embodiment takes advantage of the valve unit proposed above to supply a pump that is constructively simpler, more compact and relatively more cost-effective.

According to a preferred aspect of this embodiment, the discharge conduit of the valve unit can be in communication with the intake conduit of the pump.

In this way, all of the fluid that flows in the discharge conduit is advantageously recirculated inside the pump.

BRIEF DESCRIPTION OF THE DRAWINGS

Further characteristics and advantages of the invention will become clear from reading the following description provided as an example and not for limiting purposes, with the help of the figures illustrated in the attached tables.

DETAILED DESCRIPTION

Figure 1:
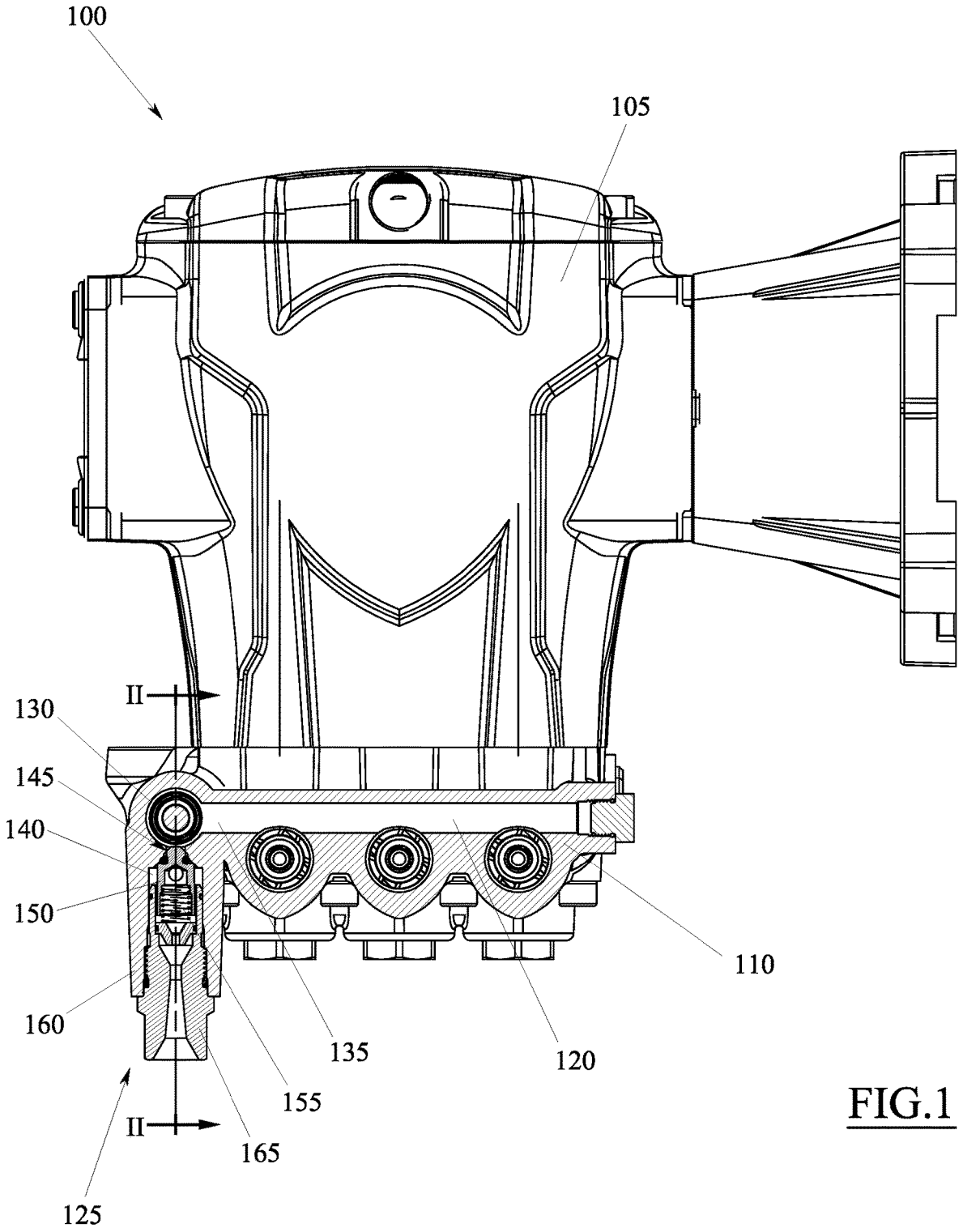
FIG. 1 is a plan view of a pump according to an embodiment of the present invention, the head of which is sectioned according to the plane I-I indicated in FIG. 2.

FIG. 1 shows a pump 100, in this case a positive displacement pump using pistons, which can be installed on a pressure washer or on another machine or system for distributing or dispensing pressurised fluids (typically water).

The pump 100 comprises a pump body 105, defining one or more cylinders, and a head 110, fixed to the pump body 105 and adapted for closing an end of each cylinder.

Inside every cylinder a reciprocating piston is slidably received, said piston being adapted for defining, together with the corresponding cylinder and the head 110, a respective variable volume compression chamber.

The pistons are kinematically connected to a single transmission shaft through a respective linkage, for example a crankshaft linkage, which is adapted for transforming the rotary motion of the actuation shaft into a reciprocating linear movement of the piston.

The transmission shaft can be set in rotation by an actuation motor, for example by an electric motor or alternatively by an internal combustion engine. The cylinders, the pistons, the compression chambers, the transmission shaft and the actuation motor are not illustrated or visible in the figures since they are per se known and conventional.

Figure 2:
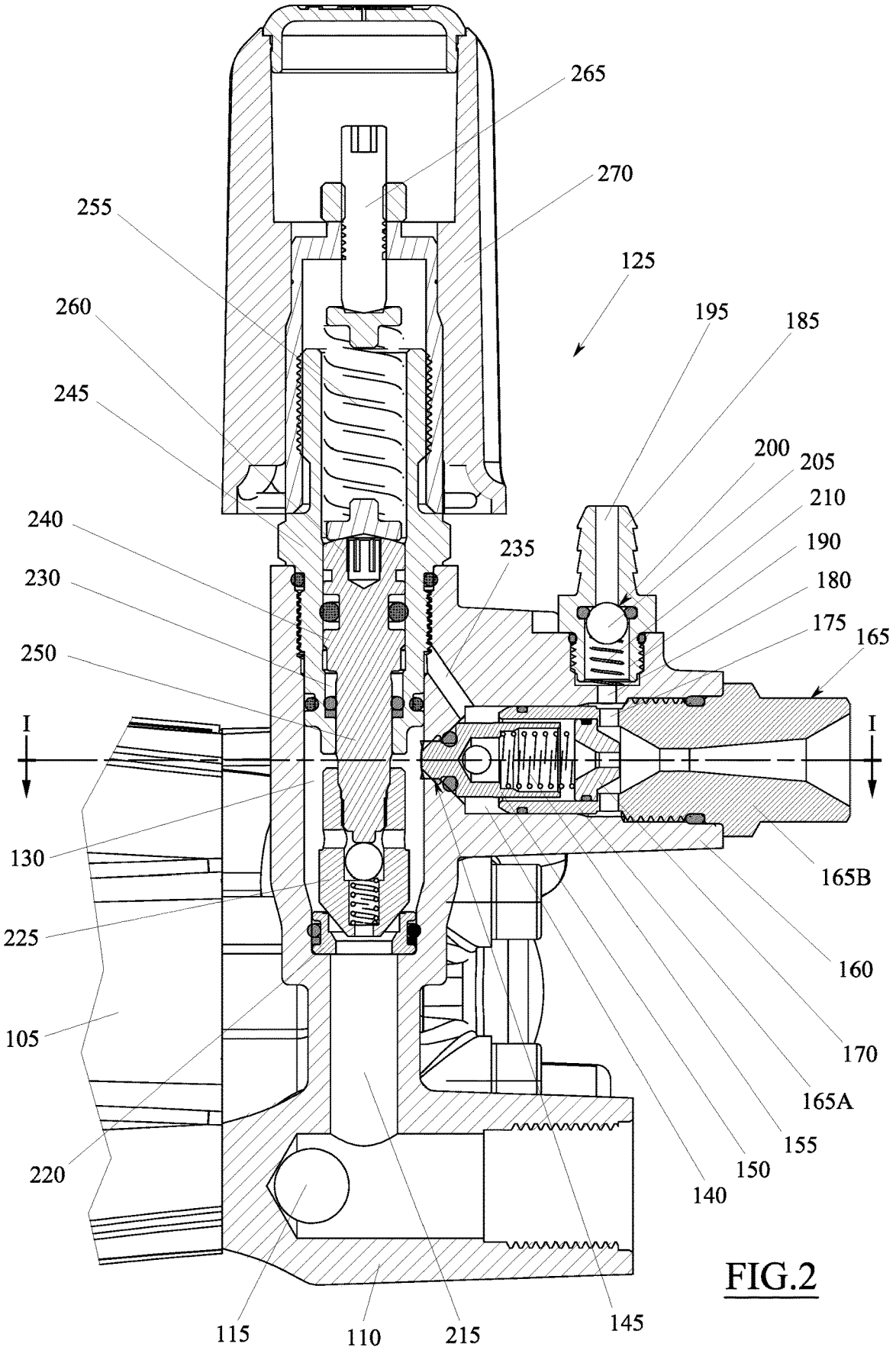
FIG. 2 is the section II-II of FIG. 1 shown with an enlarged scale.

The pump 100 comprises an intake manifold 115 (see FIG. 2) and a delivery manifold 120 (see FIG. 1), both of which can be made in the head 110.

Each compression chamber can be connected to the intake manifold 115 through a respective intake valve and to the delivery manifold 120 through a respective delivery valve.

The intake and delivery valves can be automatic valves and are per se conventional.

The intake manifold 115 can be connected to a tank containing the fluid to be pumped, whereas the delivery manifold 120 can be connected to a dispensing device, for example to a dispensing spout or gun.

The dispensing device can be equipped with suitable valve members adapted for selectively opening and closing the dispensing of the fluid following a manual actuation.

Between the delivery manifold 120 and the dispensing device it is possible to hydraulically arrange a valve unit, globally indicated with reference numeral 125.

The valve unit 125 comprises a first chamber 130 (see FIG. 2), which can be in constant hydraulic communication with the delivery manifold 120 through an inlet conduit 135 (see FIG. 1).

In the embodiment illustrated here, the first chamber 130 is made in the body of the head 110 and the inlet conduit 135 can coincide with an end segment of the delivery manifold 120.

However, this does not rule out the possibility that, in other embodiments, the first chamber 130 and the inlet conduit 135 can be made in a separate body with respect to the head 110.

The valve unit 125 also comprises a second chamber 140 (see FIG. 2), which is in hydraulic communication with the first chamber 130 through a first valve seat 145.

It should be specified that, in the present description, the term valve seat is meant to generically indicate any passage, opening or hole, of any shape and size, which is adapted for placing two separate volumes in hydraulic communication and is adapted for being obstructed by a corresponding obturator body, to selectively prevent such communication.

The second chamber 140 can be made in the same body in which the first chamber 130 is made, for example in the body of the head 110.

Inside the second chamber 140 a first obturator body 150 is housed, which is movable between a closed position, in which it closes the first valve seat 145 preventing the communication between the first and the second chamber 130 and 140, and an open position, in which it opens the first valve seat 145 allowing the communication.

The first obturator body 150 can be constantly pushed towards the closed position by a first resilient element 155, for example by a spring, which acts in contrast with the pressure of the fluid in the first chamber 130.

The second chamber 140 is furthermore in communication with an outlet conduit 160, which is adapted for being connected for example with the dispensing device.

The outlet conduit 160 can be made in the same body in which the first chamber 130 is made, for example in the body of the head 110, and can extend substantially in as a continuation of the second chamber 140.

Inside the outlet conduit 160 it is possible to insert a joining pipe 165, which comprises a first portion 165A that extends inside the second chamber 140, and a second portion 1658 that projects partially outside of the outlet conduit 160, for example to be connected to the dispensing device.

The first portion 165A of the joining pipe 165 can have a substantially cylindrical shape and can coaxially contain an annular insert 170, which can be locked axially by a circumferential shoulder formed in the first portion 165A.

The first portion 165A can at least partially receive the first obturator body 150, which can be shaped like a cup with the concavity facing towards the annular insert 170.

The first resilient element 155 can be comprised and compressed between the annular insert 170 and the first obturator body 150, for example partially contained in the cavity of the latter.

The annular insert 170 defines a passage channel that places the internal cavity of the first portion 165A of the joining pipe 165 in communication with the internal cavity of the second portion 1658 and, consequently, the second chamber 140 in communication with the outlet conduit 160.

Preferably, the passage channel defined by the annular insert 170 has a convergent shape in the outlet direction of the fluid, whereas the internal cavity of the second portion 165B of the joining pipe 165 has one or more divergent segments, so as to create, by venturi effect, a localised depression in an intermediate area of the joining pipe 165 that is immediately downstream of the annular insert 170.

Through one or more radial holes 175 made in the joining pipe 165, this intermediate area is placed in hydraulic communication with an auxiliary conduit 180 that, for example through a fitting 185, can be place in communication with a tank of an additive to be added and mixed with the fluid being dispensed.

The auxiliary conduit 180 can be made in the same body in which the first chamber 130 is made, for example in the body of the head 110.

Preferably, the fitting 185 comprises an internal cavity 190, in communication with the auxiliary conduit 180, and a connection conduit 195 that is adapted for being connected with the tank of the additive and that is in communication with the internal cavity 190 through a valve seat 200.

The internal cavity 190 of the fitting 185 can receive an obturator body 205, for example shaped like a ball, which is movable between a closed position, in which it closes the valve seat 200, and an open position, in which it opens the valve seat 200.

A resilient element 210, for example a spring, can furthermore be inserted in the internal cavity 190 to push the obturator body 205 towards the closed position in the same direction as the pressure that exists in the intermediate area of the joining pipe 165.

The valve unit 125 also comprises a discharge conduit 215, which is in hydraulic communication with the first chamber 130 via a second valve seat 220.

The discharge conduit 215 can be made in the same body in which the first chamber 130 is made, for example in the body of the head 110.

Preferably, the discharge conduit 215 is adapted for placing the first chamber 130 in communication with the intake manifold 115 of the pump 100.

However, this does not rule out the possibility that, in other embodiments, the discharge conduit 215 can place the first chamber 130 in communication with other low-pressure volumes, for example with the tank of the liquid to be pumped.

The second valve seat 220 can be made from a separate annular body that is inserted inside the first chamber 130, possibly with the interposition of suitable sealing gaskets.

Inside the first chamber 130 a second obturator body 225 is housed, which is movable between a closed position, in which it closes the second valve seat 220 preventing the communication between the first chamber 130 and the discharge conduit 215, and an open position, in which it opens the second valve seat 220, allowing such communication.

The valve unit 125 also comprises a third chamber 230, separate from the first chamber 130 but in constant hydraulic communication with the second chamber 140.

For example, the third chamber 230 and the second chamber 140 can be in communication through a connection conduit 235 that can be obtained in the body of the head 110.

The third chamber 230 is partially delimited by a sliding plunger 240, which is rigidly fixed to the second obturator body 225 so that the pressure of the fluid in the third chamber 230 tends to move the second obturator body 225 towards the open position of the discharge conduit 215.

In greater detail, the plunger 240 can be slidably received inside a cylinder 245 a bottom wall of which separates the first chamber 130 from the third chamber 230.

In this way, the third chamber 230 is actually delimited between the plunger 240 and the bottom wall of the cylinder 245.

In the illustrated example, the cylinder 245 is made in a separate body with respect to the body in which the first chamber 130 is made, in this case with respect to the body of the head 110, and can be rigidly joined to the latter for example through a threaded connection and with the interposition of suitable sealing gaskets.

However, this does not rule out the possibility that, in other embodiments, the cylinder 245 can be made in a single body with the body in which the first chamber 130 is made.

In any case, the cylinder 245 can be provided with transversal holes (not illustrated) adapted for placing the third chamber 230 in communication with the connection conduit 235.

The second obturator body 225 can be rigidly connected to the plunger 240 through a stem 250, which slidably slots into a through hole formed in the bottom wall of the cylinder 245, with which one or more gaskets are preferably associated, adapted for ensuring that the first chamber 130 and the third chamber 230 remain hermetically separated.

In particular, the stem 250 can be made in a single body with the plunger 240 whereas it can be removably connected to the second obturator body 225, for example through a threaded connection.

The valve unit 125 comprises a second resilient element 255, for example a spring, which is adapted to push the second obturator body 225 towards the closed position of the second valve seat 220 and thus of the discharge conduit 215.

In the illustrated example, this second resilient element 255 is positioned on the opposite side of the plunger 240 with respect to the stem 250, outside of the third chamber 230.

In particular, the second resilient element 255 can be partially received in the cylinder 245 and be arranged between a first abutment element 260, rigidly connected to the plunger 240, and a second abutment element 265 rigidly connected to the cylinder 245.

The first abutment element 260 can be made in a single body with the plunger 240, from which it can be separated by a gasket adapted for remaining in contact with the inner surface of the cylinder 245 to ensure the seal of the third chamber 230.

The second abutment element 265, which can be shaped like a pin coaxial to the plunger 240, can be rigidly fixed to a cover 270, which can in turn be rigidly fixed on the cylinder 245, for example screwed.

In greater detail, the second abutment element 265 can be coupled with the cover 270 through a threaded connection, so that, by screwing or unscrewing the secondo abutment element 265 with respect to the cover 270, it is possible to cause an axial movement of the second abutment element 265 in the sliding direction of the plunger 240, changing the precompression of the second resilient element 255 and, therefore, the force with which the second obturator body 225 is pushed towards the closed position.

Figure 3:
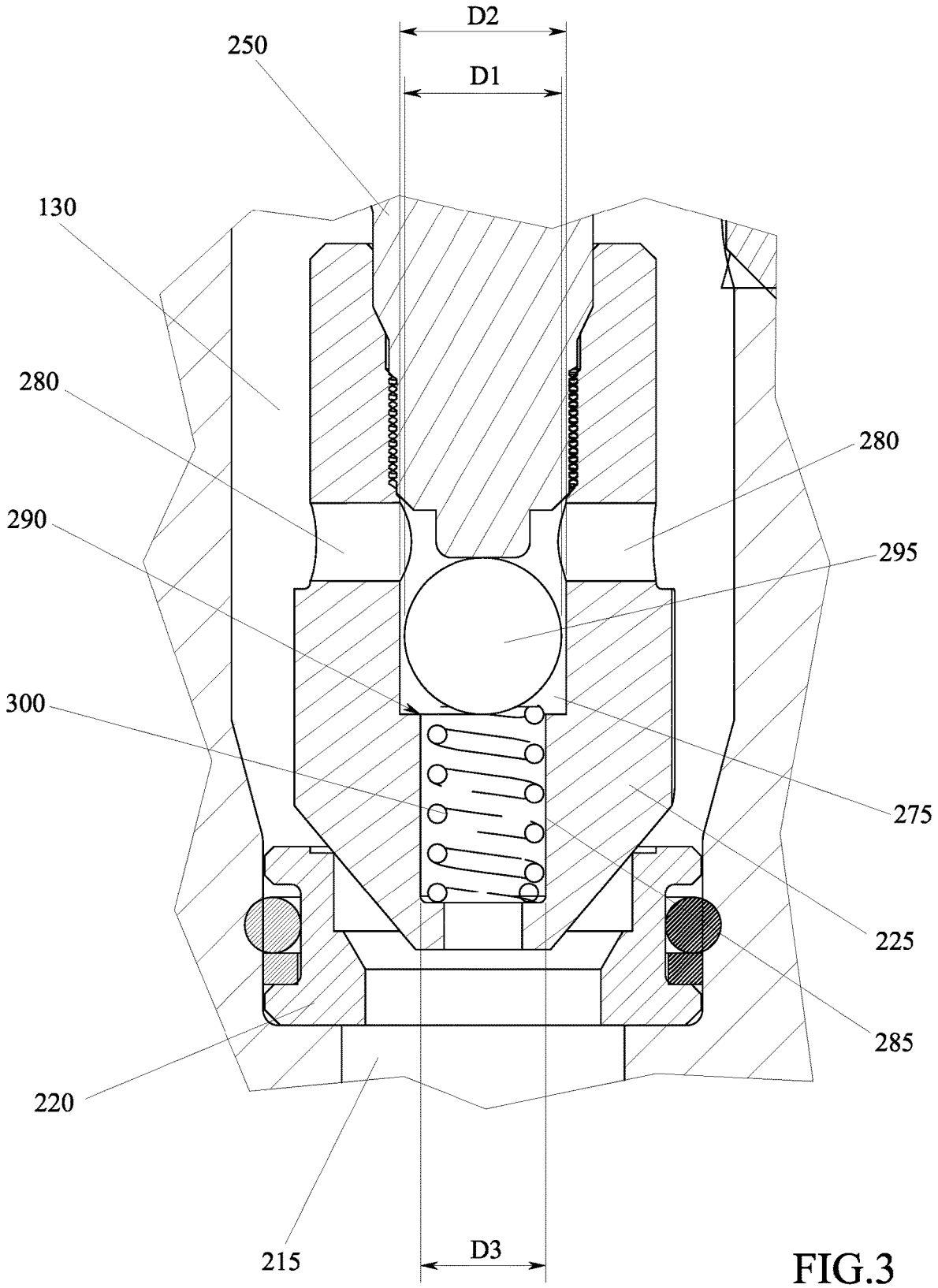
FIG. 3 is an enlarged detail of FIG. 2.

As illustrated in the enlarged detail of FIG. 3, the second obturator body 225 comprises an internal cavity 275, which is constantly in communication with the first chamber 130.

The internal cavity 275 can have a substantially cylindrical shape, for example having axis coinciding with the axis of the stem 250, and can be in communication with the first chamber 130 through one or more radial holes 280 formed in the second obturator body 225.

The radial holes 280 can be arranged equally angularly spaced apart around the axis of the internal cavity 275.

In greater detail, the second obturator body 225 can be generically cup shaped, the mouth of which is fixed, for example screwed, to the stem 250.

In this way, the internal cavity 275 can remain defined between the end of the stem 250 and the bottom wall of the cup-shaped body that makes the second obturator body 225.

The radial holes 280 can be formed in the side wall of said cup-shaped body, placing the internal cavity 275 constantly in communication with the first chamber 130.

A connection conduit 285 is also made in the second obturator body 225, said connection conduit 285 being constantly in communication with the discharge conduit 215 and being in communication with the internal cavity 275 via a third valve seat 290.

The connection conduit 285 can be made in the bottom wall of the second obturator body 225, for example so as to be coaxial with the internal cavity 275.

The connection conduit 285 can comprise two cylindrical portions, for example mutually coaxial, one of which is a first portion of smaller diameter that opens into the discharge conduit 215 and the other is a second portion of greater diameter that opens into the internal cavity 275 through the aforementioned third valve seat 290.

The third valve seat 290, which can be simply defined as the section of the connection conduit 285 that opens into the internal cavity 275, can be a circular seat and can be arranged coaxially with the internal cavity 275.

The internal cavity 275 receives a third obturator body 295, for example shaped like a ball.

The third obturator body 295 is movable between a closed position, in which it closes the third valve seat 290 preventing the communication between the internal cavity 275 and the discharge conduit 215, and an open position, in which it opens the third valve seat 290 allowing such communication.

The diameter D1 of the third obturator body 295 is less than the diameter D2 of the internal cavity 275 but greater than the diameter D3 of the third valve seat 290.

In particular, it is preferable for the diameter D1 of the third obturator body 295, the diameter D2 of the internal cavity 275 and the diameter D3 of the third valve seat 290 to satisfy the following relationships:

$$\frac{D1}{D3} \leq 1.25$$

and $$\frac{D2}{D1} \leq 1.25$$

A third resilient element 300, for example a spring, can be received inside the second obturator body 225 to push the third obturator body 295 towards the open position, in contrast with the pressure of the fluid inside the first chamber 130.

For example, the third resilient element 300 can be partially received in the second portion of the connection conduit 285, so as to rest on the annular shoulder defined between the first and the second portion of the connection conduit 285 itself, and can partially project in the internal cavity 275 to be in contact with the third obturator body 295.

The operation of the valve unit 125 described above will be described hereinafter from the condition in which the actuation motor of the pump 100 is off and the pump 100 is stopped.

In this condition, the first obturator body 150 and the second obturator body 225 are both in the respective closed position, whereas the third obturator body 295 is in open position.

When the actuation motor is set in motion, the pistons of the pump 100 immediately begin to pump at least a small amount of fluid from the intake manifold 115 to the delivery manifold 120.

Since the third obturator body 295 is in open position, this initial amount of fluid flows freely from the first chamber 130 of the valve unit 125 towards the discharge conduit 215, passing through the radial holes 280, the internal cavity 275 and the connection conduit 285 that are obtained in the second obturator body 225.

In this way, the pumped fluid can recirculate directly in the intake manifold 115 of the pump 100.

The pump 100 does not therefore apply a strong hydraulic resistance to the actuation motor, which can easily reach the rotation speeds that allow it to sustain the combustion, if it is an internal combustion engine, or the rotation speeds for which it is able to provide an adequate torque value, if it is an electric motor, for example an electric motor with inverter.

As the rotation speeds of the motor progressively increase, the flow rate of fluid that is pumped in the first chamber 130 of the valve unit 125 also increases.

In this way, the pressure and the dynamic push that the fluid exerts on the third obturator body 295 become sufficiently high as to overcome the resistance of the third resilient element 300, taking the third obturator body 295 into closed position.

At this point, the pumped fluid no longer recirculates through the discharge conduit 215 but pushes the first obturator body 150 towards the open position, in contrast with the action of the first resilient element 155, thus flowing into the second chamber 140 and from here into the outlet conduit 160 for example towards the dispensing device from which it comes out.

Passing through the joining pipe 165, the fluid can be subjected, by Venturi effect, to a pressure drop that, in certain conditions, is sufficient to overcome the force of the resilient element 210, opening the obturator body 205 and drawing the additive inside the stream of fluid being dispensed.

Regardless of these considerations, during the dispensing of the fluid, the pressure in the third chamber 230 is substantially equal to the pressure in the second chamber 140.

As long as this pressure is not able to overcome the force exerted on the plunger 240 by the second resilient element 255, the second obturator body 225 remains in closed position and the dispensing continues as described earlier.

If, however, the flow rate of pumped fluid increases and/or if the dispensing device is closed, the pressure in the second chamber 140 and in the third chamber 230 increases, increasing the push exerted on the plunger 240 in contrast with the second resilient element 255.

When such a pressure exceeds a critical value (e.g. 150 bar), able to be set and adjusted through the adjustment of the preload of the second resilient element 255, the second obturator body 225 moves away from the second valve seat 220, opening a direct communication between the first chamber 130 and the discharge conduit 215.

In this way, all of the fluid pumped by the pump 100, or at least the flow rate of excess fluid, flows through the discharge conduit 215, for example towards the intake manifold 115, thereby ensuring that the pressure of the fluid at the outlet of the valve unit 125 never exceeds the preset critical value or, in any case, that it begins to oscillate, still staying around such a critical value.

Of course, those skilled in the art can bring numerous technical application modifications to the pump 100 and to the valve unit 125 described above, without for this reason departing from the scope of the invention as claimed below.

The invention claimed is:

1. A valve unit (125) for pumps (100) comprising:

an inlet conduit (135), a first chamber (130) communicating with the inlet conduit (135), a second chamber (140) communicating with the first chamber (130) via a first valve seat (145), an outlet conduit (160) communicating with the second chamber (140), a first obturator body (150) housed within the second chamber (140) and movable between a closed position, wherein the first obturator body (150) closes the first valve seat (145), and an open position, wherein the first obturator body (150) opens the first valve seat (145), a first resilient element (155) adapted to push the first obturator body (150) towards the closed position in contrast with a pressure present within the first chamber (130), a discharge conduit (215) communicating with the first chamber (130) via a second valve seat (220), a third chamber (230) communicating with the second chamber (140) and partially defined by a sliding plunger (240), a second obturator body (225) rigidly connected to the plunger (240) and housed in the first chamber (130) where the second obturator body (225) is movable between a closed position, wherein the second obturator body (225) closes the second valve seat (220), and an open position, wherein the second obturator body (225) opens the second valve seat (220), and a second resilient element (255) adapted to push the second obturator body (225) towards the closed position in contrast with a pressure present within the third chamber (230), an internal cavity (275) obtained in the second obturator body (225) and communicating with the first chamber (130), a connection conduit (285) obtained in the second obturator body (225), which is in communication with the discharge conduit (215) and in communication with the internal cavity (275) via a third valve seat (290), a third obturator body (295) housed within the internal cavity (275) of the second obturator body (225) and movable between a closed position, wherein the third obturator body (295) closes the third valve seat (290), and an open position, wherein the third obturator body (295) opens the third valve seat (290), and a third resilient element (300) capable of pushing the third obturator body (295) towards the open position in contrast with the pressure present in the first chamber (130).

2. The valve unit (125) according to claim 1, wherein the third obturator body (295) is a spherical body.

3. The valve unit (125) according to claim 2, wherein the internal cavity (275) of the second obturator body (225) is a cylindrical cavity.

4. The valve unit (125) according to claim 3, wherein a ratio between a diameter (D2) of the internal cavity (275) of the second obturator body (225) and a diameter (D1) of the third obturator body (295) is less than or equal to 1.25.

5. The valve unit (125) according to claim 3 wherein the third valve seat (290) is coaxial with the internal cavity (275) of the second obturator body (225).

6. The valve unit (125) according to claim 2, wherein the third valve seat (290) is a circular seat.

7. The valve unit (125) according to claim 6 wherein a ratio between a diameter (D1) of the third obturator body (295) and a diameter (D3) of the third valve seat (290) is less than or equal to 1.25.

8. A pump (100) comprising an intake manifold (115), a delivery manifold (120) and the valve assembly (125) according to claim 1 with the inlet conduit (135) being in communication with the delivery manifold (120).

9. The pump (100) according to claim 8, wherein the discharge conduit (215) of the valve unit (125) is in communication with the intake manifold (115).

* * * * *